US009140056B2

(12) United States Patent
Fitzpatrick

(10) Patent No.: US 9,140,056 B2
(45) Date of Patent: Sep. 22, 2015

(54) ADJUSTABLE WIDTH STAIRWELL BARRICADE

(75) Inventor: Janelle Fitzpatrick, Milton, GA (US)

(73) Assignee: BETTER OPTIONS LLC, Milton, GA (US)

( * ) Notice: Subject to any disclaimer, the term of this patent is extended or adjusted under 35 U.S.C. 154(b) by 0 days.

(21) Appl. No.: 12/380,828

(22) Filed: Feb. 25, 2009

(65) Prior Publication Data

US 2009/0211716 A1 Aug. 27, 2009

Related U.S. Application Data

(60) Provisional application No. 61/031,013, filed on Feb. 25, 2008.

(51) Int. Cl.
*A47H 13/00* (2006.01)
*E06B 9/02* (2006.01)

(52) U.S. Cl.
CPC ..... *E06B 9/02* (2013.01)

(58) Field of Classification Search
USPC ..... 160/368.1, 327, 354, 383, 387, 388, 160/389, 390
See application file for complete search history.

(56) References Cited

U.S. PATENT DOCUMENTS 736,242 A * 8/1903 Gable ..... 160/44
832,335 A * 10/1906 McDonald ..... 160/264
5,358,025 A * 10/1994 Wood ..... 160/368.1
5,394,927 A * 3/1995 Huebner ..... 160/327
5,407,178 A * 4/1995 Long ..... 256/45
5,460,409 A * 10/1995 Conner ..... 280/749
5,533,715 A * 7/1996 Dandrea ..... 256/45
5,620,040 A * 4/1997 Swanner ..... 160/354
6,470,948 B2 * 10/2002 Yates et al. ..... 160/35
8,397,738 B2 * 3/2013 Livacich et al. ..... 135/90
2001/0015266 A1 * 8/2001 Yates et al. ..... 160/84.06
2006/0180284 A1 * 8/2006 Wiggins ..... 160/368.1

* cited by examiner

*Primary Examiner* — Katherine Mitchell
*Assistant Examiner* — Abe Massad
(74) *Attorney, Agent, or Firm* — Todd Partners, P.C.; Jack D. Todd

(57) ABSTRACT

An adjustable width barricade includes a frameless, flexible, washable, aesthetically attractive, and generally-rectangular barrier that mounts between banisters of a stairwell. The adjustable width barricade does not require drilling into the stairwell banisters and is removeably mountable without damaging either the structural integrity or decorative finish of wooden banisters, balusters, rails, or posts. Multiple strap-like fasteners attach the barrier to stairway banisters or posts, including posts having vertically varying diameters and configurations, that are non-parallel relative to each other, that are non-perpendicular relative to the flooring surface, or that are otherwise asymmetrical. A plurality of rigid, structural support members are inserted into vertical channels in the barrier that maintain the height of the barrier when installed. One or more adjustable length lateral straps enable the barrier to be tightened to fit securely, without gaps, and with tension, from banister to banister, across stairways of varying size, style, shape, and width.

20 Claims, 5 Drawing Sheets

ADJUSTABLE WIDTH STAIRWELL BARRICADE

RELATED APPLICATIONS

This application claims priority to, and the benefit of, U.S. Provisional Patent Application entitled "Adjustable Width Stairwell Safety Gate," having assigned Ser. No. 61/031,013, filed on Feb. 25, 2008 on behalf of Janelle Fitzpatrick.

FIELD OF THE INVENTION

The present invention relates generally to child safety barriers, and more specifically to an adjustable width stairwell child safety gate comprised of a frameless, non-rigid, washable, attractive, planar barrier device to prevent ingress and egress of a small child into a stairway passage.

BACKGROUND

Conventional child safety gates are typically comprised of an inflexible outer frame structure having rigid horizontal and vertical members to support such frame. Conventional gates typically aesthetically detract from the attractiveness of newer homes. Conventional rigid framed gates are difficult to install and equally difficult to disassemble and remove or relocate. Furthermore, conventional rigid framed gates require drilling into the walls and wooden banisters, or in the alternative, they require tedious assembly of clumsy wooden or plastic faceplates that are then hinged to the existing stairway rails as a means of attaching the safety gate. Furthermore, conventional rigid framed child safety gates are not adaptable to snugly attach to custom decorative stairway posts, banisters or balusters having vertically varying diameters and configurations, or that are non-parallel relative to each other, or that are non-perpendicular relative to flooring surface or that are otherwise asymmetrical. Typical state of the art child safety gates often leave large gaps between the safety gate and the stairway railing in which a small child may become trapped or wedged while attempting to wiggle through such a gap.

Some patents have been issued in the art of child safety barriers:

U.S. Pat. No. 4,852,194, entitled "Safety Barrier for Small Children", issued to Jeffrey M. Langan on Aug. 1, 1989, discloses a barrier or safety guard for preventing the escape of small children from a safe area, having as its basic element a panel of flexible material, preferably in the form of netting with relatively small apertures therein. A border of flexible material is provided for the periphery of the panel and has a plurality of spaced openings around the entire periphery of the panel. These openings are provided with grommets and a plurality of ties or laces by which the borders of the panel can be fastened to points on the supporting structure. The panel can be folded in either or both dimensions to adjust its size to smaller dimensions. Small sub-panels can be used to prevent the main panel from being dislodged.

U.S. Pat. No. 5,617,674, entitled "Adjustable Passage Gate", issued to Timothy T. Terril on Apr. 8, 1997, discloses an adjustable passageway gate that includes a thin generally rectangular-parallelepiped-shaped panel, a large, extendable, retractable, and generally rectangular-parallelepiped-shaped extension member, a pair of small, spaced-apart, extendable, retractable, and generally rectangular-parallelepiped-shaped extension members, an elongated and generally rectangular-parallelepiped-shaped cross member, and a bolt. The thin generally rectangular-parallelepiped-shaped panel is positionable on one side of a wall. The large, extendable, retractable, and generally rectangular-parallelepiped-shaped extension member and the pair of small, spaced-apart, extendable, retractable, and generally rectangular-parallelepiped-shaped extension members are extendable to contact the wall when the passageway of the wall is wider than the thin generally rectangular-parallelepiped-shaped panel.

U.S. Pat. No. 6,470,948, entitled "Safety Gate", issued to Robert Yates on Oct. 19, 2002, discloses a collapsible, child, safety gate for selectively forming a barrier across an opening inside a house such as a stairwell, including a storage housing capable of being fixed in position across the house opening, either permanently or temporarily, and a folding curtain-which can be stored in the storage housing when folded and which can be withdrawn therefrom along guide tracks to an extended position for forming a barrier across the opening.

U.S. Pat. No. 4,787,174, entitled "Child Safety Gate", issued to Tyrone Brown on Nov. 28, 1988, discloses a sturdy, effective and economical portable barrier is provided to safely restrain and protect babies, toddlers and pets. The safety barrier comprises spring-biased decorative panels which expand to securely engage a door frame contract to a compact compressed position.

U.S. Patent Publication No. US 2006/0042163 A1, entitled "Baby Gate", filed by Allen S. Nitz on Aug. 27, 2004 discloses a gate assembly for selectively opening and closing a passageway includes opposed sides defined by a pair of newel posts. The gate assembly includes a gate, first and second mounting assemblies and a pair of hinges. Each mounting assembly includes a mount face plate, a backing plate and a plurality of fasteners for mounting the face plate to one of the posts. The hinges define a hinge axis and couple the gate to the first mounting assembly face plate and permit pivotal movement of the gate about the hinge axis between first and second open positions and through a closed position through an arc of about 270°. The gate is substantially parallel to the face plate when in the closed position. A caster wheel is coupled with the bottom of the gate in order to facilitate pivotal movement of the gate and to inhibit undesired forces on the hinges.

U.S. Patent Publication No. US 2006/0180284 A1, entitled "Child Safety Gate", filed by Katherine Wiggins on Feb. 15, 2005, discloses a child safety gate comprises a rigid frame structure including a pair of transversely spaced rigid upright frame legs and an intermediate leg positioned at right angles to the upright frame legs, a flexible gate member having means securing the gate member in unitary assembly with the rigid frame structure; and a pair of flexible strap-like adjustable hinges secured to the transversely spaced rigid upright frame legs for securing the flexible adjustable foldable hinges to stairway posts. Each of the flexible adjustable hinges is comprised of a flexible top strip piece having a cushioned non-slip fabric layer secured on an inside surface and each of the strip pieces and the cushioned non-slip fabric layer are sized, shaped and positioned for assembled contact with upright stairway posts to present slipping of the straps thereby keeping the gate firmly position and to avoid scratching of the upright stairway posts when attached to the upright stairway posts.

U.S. Pat. No. 7,178,792, entitled "Child Safety Barriers", issued to Robert D. Monahan on Feb. 20, 2007, discloses a child safety gate including a flexible barrier that is retractable into a housing and extendable across a passageway to inhibit passage by a child. An electrically operable extension lock solenoid inhibits barrier extension until activated by a parent. The gate includes a motion sensor, a night light, a child monitor and an interactive audio-visual display.

U.S. Pat. No. 5,437,115, entitled "Security Gate Apparatus", issued to T. Brent Freese on Aug. 1, 1995, discloses a security gate apparatus for attachment across an opening defined by first and second vertical surfaces, including a first gate panel and a second gate panel slidingly connected to the first gate panel so as to permit horizontal extension and retraction of the gate apparatus to a desired horizontal dimension. A first vertical leg is pivotably attached to an outer vertical member of the first gate panel by a first link means and a second vertical leg is pivotably connected to an outer vertical member of the second gate panel by a second link means. The security gate apparatus also includes means for locking the first and second gate panels in the desired horizontal dimension and at least one contact pad on a surface of the first and second vertical legs opposite the outer vertical members of the first and second gate panels, respectively.

U.S. Pat. No. 5,531,258, entitled "Folding Soft Gate", issued to Keith L. Poulson on Jul. 2, 1996, discloses a security gate for positioning within an area way such as a doorway. The gate includes a support structure defined by a frame and a flexible panel supported by the frame. The frame includes horizontal members and vertical members wherein the vertical members may be conveniently folded to a position parallel to the horizontal members whereby the gate is folded to a compact configuration for transportation or storage.

While these patents teach the general concept of barriers to implement for child safety, they do not teach a frameless, non-rigid child safety barrier mechanism particularly suited for forming a barrier from banister to banister without damaging either the structural integrity or decorative finish of ornamentally designed wooden banisters, balusters, rails or posts.

Conventional gates may be somewhat satisfactory in generally preventing the ingress and egress of small children through stairway passages, there is a tremendous need for a frameless, non-rigid, washable, attractive, planar child safety gate that is capable of widening and selectively expanding to securely fit across a variety of stairwell configurations, particularly from banister to banister. Additionally, there is a need for such a flexible child safety gate that will not damage the stairway banister and that will aesthetically compliment the modern elegant homes having high-end custom stairway posts, balusters and banisters. Furthermore, there is a need for an improved flexible child safety gate that is readily removable and has the practical attribute of being washable.

Thus there remains a need for an invention having an improved frameless adjustable-width child safety gate comprising a washable aesthetically appealing flexible barrier device to prevent ingress and egress of a small child into a stairway passage and a means for attaching frameless barrier device to stairway banisters or posts; including stairway posts having vertically varying diameters and configurations, or that are non-parallel relative to each other, or that are non-perpendicular relative to flooring surface or that are otherwise asymmetrical. The present invention provides a non-obvious solution to all of the above problems.

SUMMARY OF THE INVENTION

According to the present invention, there is provided an improved adjustable width stairwell child safety gate comprised of a frameless, non-rigid, washable, aesthetically attractive, planar barrier device to safely prevent ingress and egress of a small child into a stairway passage. The adjustable width stairwell child safety gate does not require drilling into the stairway banisters and therefore, will neither permanently attach to nor damage custom stairway banisters, posts, rails or balusters. The adjustable width stairwell child safety gate includes multiple strap-like fastener means for attaching frameless barrier device to stairway banisters or posts; including stairway posts having vertically varying diameters and configurations, or that are non-parallel relative to each other, or that are non-perpendicular relative to flooring surface or that are otherwise asymmetrical. The adjustable width stairwell child safety gate is extendable to securely fit, from banister to banister, across stairways of varying size, style and width. The novel adjustable width stairwell child safety gate can be compactly rolled to either side of the stairway passage when not in use to quickly and conveniently allow unrestricted access to stairway.

This improved child safety gate is particularly useful for safely preventing the passage of small children into stairway passages. To this end, the novel child safety gate is attractive, is structurally durable, and is readily removable and washable.

A more detailed explanation of the invention is provided in the following description taken in conjunction with the accompanying drawings.

BRIEF DESCRIPTION OF THE DRAWING

The present invention is best understood from the following detailed description when read in conjunction with the accompanying drawing. It is emphasized that, according to common practice, the various features of the drawing are not necessarily to scale. On the contrary, the dimensions of the various features are arbitrarily expanded or reduced for clarity. Like numerals denote like features throughout the specification and drawing.

Referring now to the drawings in which like reference numbers represent the corresponding parts throughout.

DETAILED DESCRIPTION

Although the invention has been described in terms of exemplary embodiments, the invention is not intended to be limited to the specific terminology so selected. Rather, it is to be understood that the appended claims should be construed broadly, to include all technical equivalents that operate in a similar manner to accomplish similar functions.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

Figure 1:
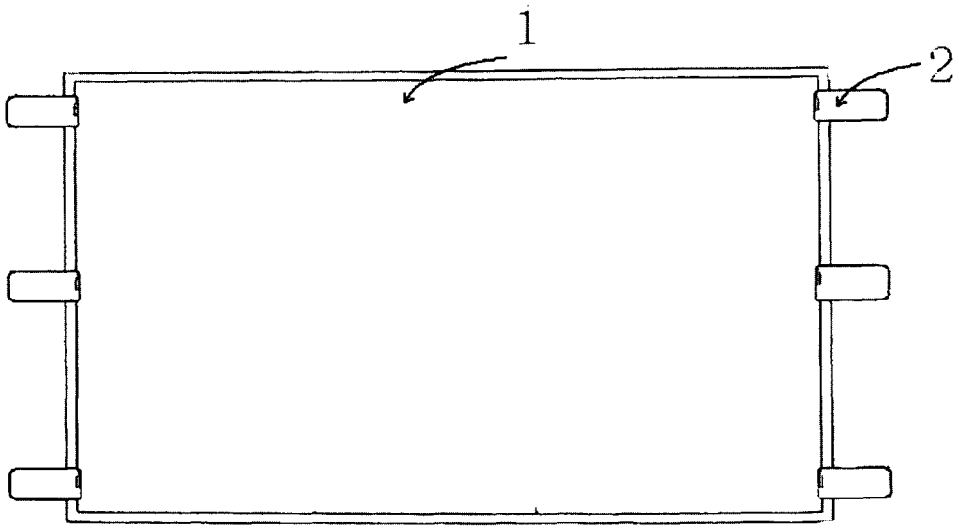
FIG. 1 illustrates a frontal perspective view of the improved adjustable width stairwell child safety gate.
Figure 2:
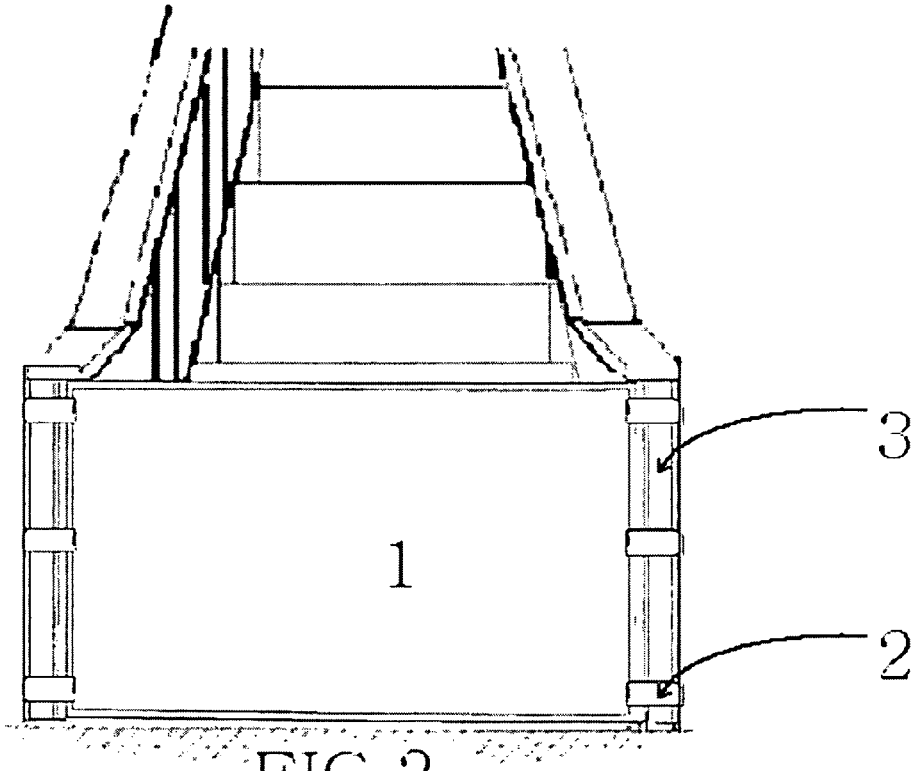
FIG. 2 illustrates a frontal perspective view of the improved adjustable width stairwell child safety gate shown in FIG. 1 installed in a stairwell passage with flexible gate member 1 extended across the stairway to prevent passage of a child.
Figure 3:
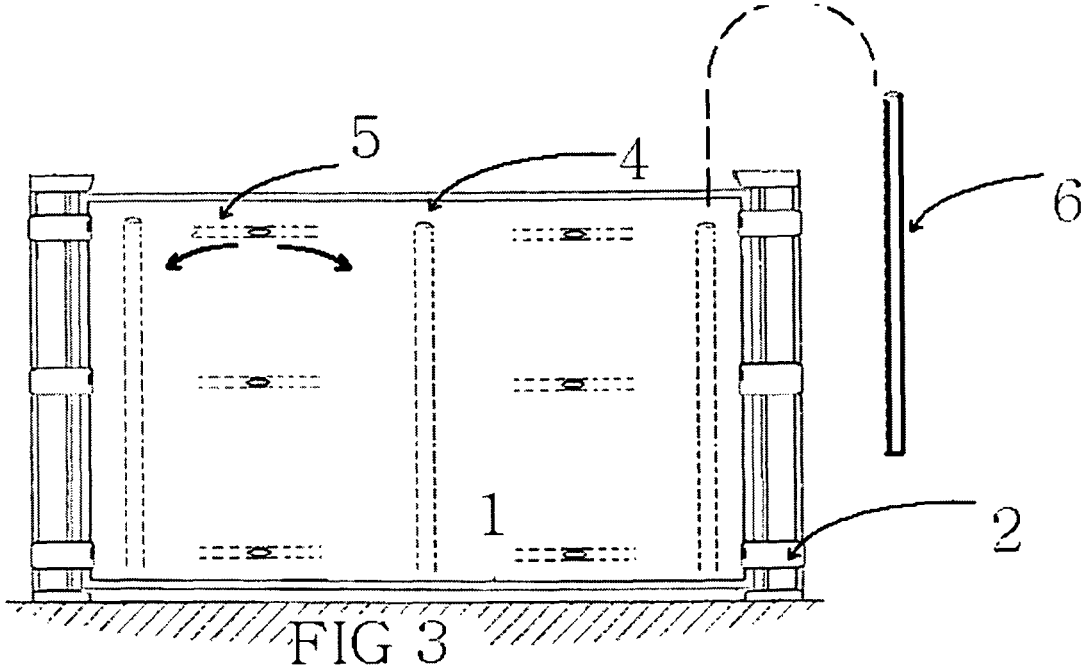
FIG. 3 illustrates a view of the reverse side of the adjustable width stairwell child safety gate shown in FIG. 1 with an intermediate section of flexible gate member shown in full and dotted lines to illustrate internal means of vertical structural support and internal means of selectively lengthening and contracting flexible gate member to securely fit across stairway passageways of differing widths.

Referring now to FIGS. 1-5, the present invention in its preferred embodiment is an adjustable width stairwell child safety gate. Most modern or new homes have elaborate, often custom-built, upright wooden stairway posts. An adjustable width stairwell child safety gate 1-2 as shown in FIG. 1 is provided for mounting upon a such configured wooden stairway as shown in FIG. 2 having a pair of upright wooden stairway posts, banisters, railings, or balusters 3. The child safety gate 1-2 is adjustable in width to securely fit in a vertical planar orientation between the posts when in assembled relation therewith to safely prevent the passage of small children. The adjustable width child safety gate 1-2 is comprised of a frameless flexible gate member 1, three pairs of fastener means indicated generally at 2 to secure the gate member 1 to the stairway posts 3. The adjustable width child safety gate 1-2 is further comprised of three vertical structural support rods 6 as shown in FIG. 3 for rigidifying the flexible gate member and three pairs of lateral adjustment means indicated generally at 5 as shown in FIG. 3 to adjust the width of the flexible gate member 1 by facilitating the engagement of longitudinal tension necessary such that flexible gate member 1 will securely fit between wooden stairway posts 3 of varying size, style and width.

Figure 4:
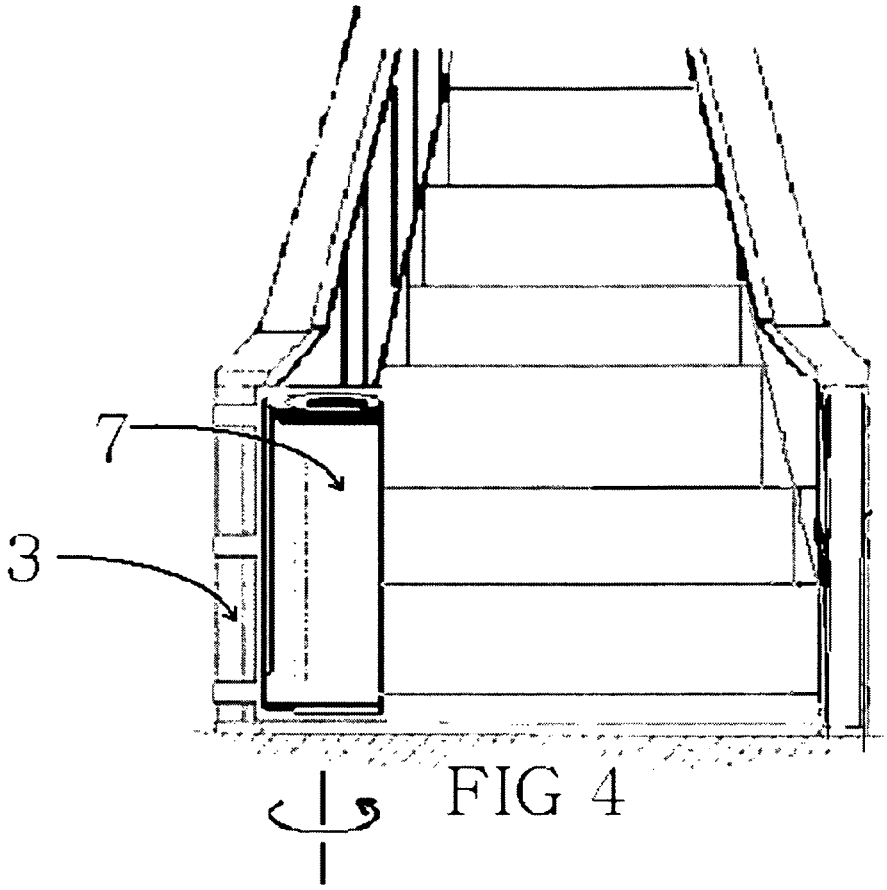
FIG. 4 illustrates a frontal perspective view of the improved child safety gate shown in FIG. 2 with frameless, non-rigid gate shown in compact coiled arrangement wherein flexible member can be compactly rolled to either side of the stairway passage when not in use to allow unrestricted access to stairway without needing to completely remove flexible member from stairway post.

A further improvement over conventional child safety gates is that this adjustable width stairwell child safety gate 7 as shown in FIG. 4 is provided for mounting upon an upright wooden stairway post 3 in vertical coiled spatial orientation wherein flexible gate member can be compactly rolled and secured in assembled relation to either side of the stairway passage when not in use to allow unrestricted access to stairway without needing to completely remove flexible gate member from 7 stairway post 3. Mounting of the adjustable width stairwell child safety gate upon one upright wooden stairway posts 3 in vertical coiled spatial orientation as shown in FIG. 4 can preferably be accomplished by disengaging, three fastener means indicated generally at 2 shown in FIG. 2 to secure the gate member 1 to a single stairway post 3.

The flexible gate member 1 as shown in FIG. 1 is preferably made or fabricated out of a durable resilient material, such as lightweight meshed netting and reinforced nylon with the attractive washable woven cloth or woven fabric used as the material for the exterior surface of the flexible gate member 1. The attractive washable woven cloth or woven fabric used as the material for the exterior surface can be of various aesthetically pleasing, decorative, ornamental designs and colors.

The adjustable fastener means 2 as shown in FIGS. 1-2 comprises three pairs of adjustable flexible strap-like hinges 2 extending laterally (horizontally) as a fastening means to secure the flexible gate member 1 to stairway posts, balusters or banisters in a planar spatial orientation. The adjustable flexible strap-like hinges 2 as shown in FIGS. 1-2 are attached to the vertical edges of the upper, mid and lower portions of the flexible gate member 1 to engage the stairway posts 3 as shown in FIGS. 2-3.

A further modification of the adjustable flexible strap-like hinges 2 as shown in FIGS. 1,2,3 and 5 may also include fasteners of different types including, but not limited to, loop type fasteners, snap type fasteners, hook and eye type fasteners. These adjustable flexible strap-like hinges 2 may also include fasteners with a cushioned non-slip fabric spatially oriented for assembled contact with the wooden upright stairway posts 3 to prevent any slipping of the flexible strap-like hinges 2 or scratching of the wooden upright stairway posts 3.

The three pairs of lateral adjustment means indicated generally at 5 as shown in FIG. 3 are preferably comprised of, but not limited to, lateral adjustment buckles to adjust the width of the flexible gate member 1 by facilitating the engagement of longitudinal tension necessary such that flexible gate member 1 will securely fit between wooden stairway posts 3 of varying size, style and width. The internal portions of the lateral adjustment buckles provide a fastening means to limit the differential expansion of the flexible gate member and thereby facilitate the secure fit of the gate member across stairways of varying size, style and width. The lateral adjustment means 5 further reinforce the strength and resilience of the flexible gate member. The lateral adjustment means 5 as shown in FIG. 3 are spatially arranged to complementingly cooperate with each other to provide a banister to banister engagement portion which enables the barrier to fully and completely horizontally span across a stairway passage.

The flexible gate member 1 shown in FIG. 3 is provided with three tubular sleeves, grooves, channels, or slots indicated generally at 4 for receiving the three removable vertical structural support rods 6. The tubular sleeves 4 can be manufactured, molded or formed by stitching portions of the edges of the fabric in lapped engagement with one side of the gate member 1 to form tubular sleeves to receive the removable vertical structural support rods 6. To fortify the structural integrity of the flexible gate member 1 and to securely hold the removable vertical structural support rods 6 rigidly in place within the flexible gate member 1 shown in FIG. 3, the preferred embodiment of the tubular sleeves 4 will have a width slightly greater than the width of the removable vertical structural support rods 6.

The three removable vertical structural support rods 6 as shown in FIG. 3 for rigidifying the flexible gate member are preferably made or fabricated out of wood, impact-resistant plastic or composite materials. As shown in FIG. 3, the rods 6 are sized and shaped to set into the tubular sleeves 4 in vertical parallel relation when in assembly together to rigidify the flexible gate member.

The preferred embodiment of the removable vertical structural support rods 6 as shown in FIG. 3 will provide limits to the upward (vertical) compression of the flexible gate member 1 to prevent a small child from raising the lower portion of the flexible gate member 1 in an upward (vertical) direction in attempting ingress or egress beneath the flexible gate member 1 into the stairway passage.

Figure 5:
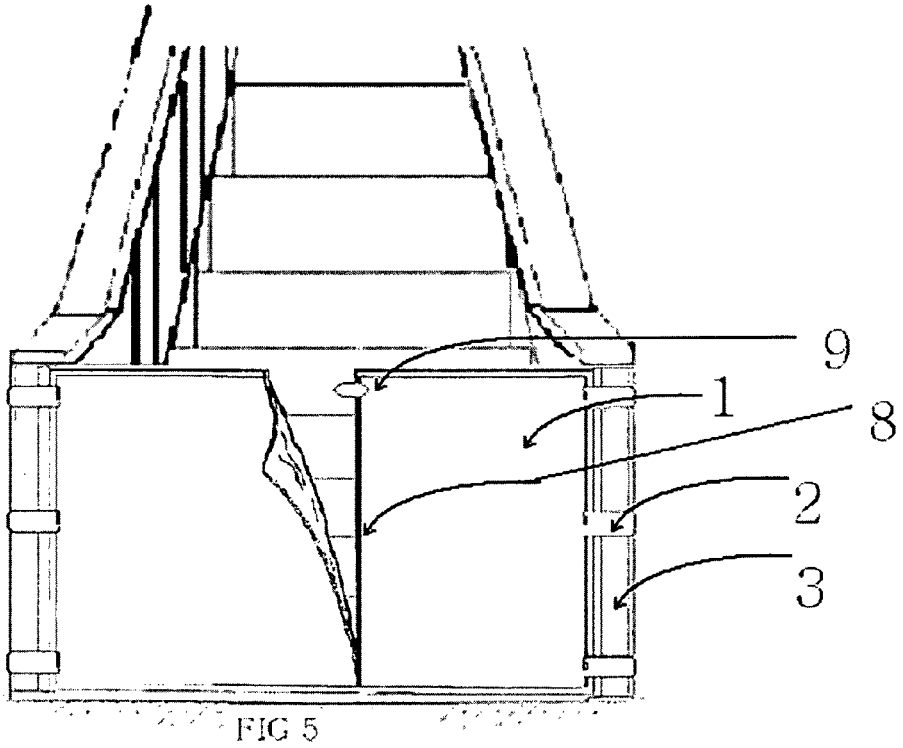
FIG. 5 illustrates a frontal perspective of the improved child safety gate as shown in FIG. 2 wherein the flexible gate member is shown in an alternative embodiment having a vertical zipper to allow ingress and egress through the flexible gate member when desired.

A further modification of the flexible gate member 1 as shown in FIG. 5 will facilitate quick ingress and egress by having a vertical spatially oriented zipper 8 which perpendicularly extends upward relative to the horizontal edge of the lower portion of the flexible gate member 1. The preferred embodiment of the vertical spatially oriented zipper 8 will, but is not limited to, bisectingly divide the flexible gate member 1 into equal partitions as shown in FIG. 5. The vertical spatially oriented zipper 8 will function in conjoined engagement with the flexible gate member 1 when in a closed position to prevent ingress and egress of small children through the flexible gate member 1. When the vertical spatially oriented zipper 8 is unzipped and thereby extended downward towards the horizontal edge of the lower portion of the flexible gate member 1, the vertical spatially oriented zipper 8 will operate to quickly permit ingress and egress through the flexible gate member 1 into the stairway passage when desired.

A further modification of the flexible gate member 1 as shown in FIG. 5 will include a securing means 9 to firmly fasten the vertical spatially oriented zipper 8 in fully upwardly extended vertical orientation adjoined to the horizontal edge of the upper portion of the flexible gate member 1. Generally, it is expected that the zipper 8 will be in a fully upwardly extended orientation relative to the horizontal edge of the upper portion of the flexible gate member 1 to prevent ingress or egress of small child into stairway passage. The securing means 9 to firmly fasten the vertical spatially oriented zipper 8 may include, but is not limited to, snap type fasteners or Velcro type fasteners.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The above-described preferred embodiments are intended to illustrate the principles of the invention, but not to limit its scope thereto. The described preferred embodiments are not intended to be exhaustive or to limit the invention to the precise form disclosed. Rather, the appended claims should be construed broadly, to include other variants and embodiments of the invention, which will be apparent to those skilled in the art and may be made without fundamentally deviating from the spirit and scope of the invention, as illustrated in the above-described preferred embodiments.

What is claimed is at least:

1. An adjustable-width barrier for removable installation between respective posts of opposed banisters of a stairwell, the respective posts having a vertical height and being a fixed horizontal distance across the stairwell from each other, comprising:

a planar, frameless, flexible, and generally-rectangular gate member having a width extending between each side edge of the gate member and a height extending between a top edge and a bottom edge of the gate member, the width, when fully expanded, being substantially equal to or greater than the fixed horizontal distance between the respective posts and the height being substantially equal to or less than the vertical height of the respective posts;

a first plurality of fasteners attached to the gate member, the first plurality of fasteners vertically spaced along and extending from one side edge of the gate member, each fastener having two straps adapted to engage in locking manner around one of the respective posts;

a second plurality of fasteners attached to the gate member, the second plurality of fasteners vertically spaced along and extending from the other side edge of the gate member, each fastener having two straps adapted to engage in locking manner around the other of the respective posts;

one of the two straps of each of the first plurality of fasteners on one side edge of the gate member connected with one of the two straps of a corresponding the second plurality of fasteners disposed at the same vertical location on the other side edge of the gate member, each of the connected straps defining an adjustable length strap that extends laterally within the gate member between the side edges; and a plurality of rigid, structural support members, each structural support member inserted within a respective vertical channel extending between the top edge and the bottom edge of the gate member, each of the vertical channels transversely spaced along the width of the gate member wherein the height of the gate member is rigidly maintained in non-compressible form by the structural support members inserted within the respective vertical channels;

wherein, when the gate member is installed between the respective posts using the first and second plurality of fasteners, the width of the gate member is contracted to match the horizontal distance between the respective posts while simultaneously the gate member is maintained in lateral tension between the respective posts of the stairwell by tightening one or more of the adjustable length straps extending between the first and second plurality of fasteners.

2. The adjustable-width barrier of claim 1 wherein the first and second plurality of fasteners each include a respective top fastener extending from its respective side edge near the top edge of the gate member and a respective bottom fastener extending from its respective side edge near the bottom edge of the gate member.

3. The adjustable-width barrier of claim 2 wherein the first and second plurality of fasteners each include at least one respective middle fastener extending from its respective side edge between the top and bottom edges of the gate member.

4. The adjustable-width barrier of claim 1 wherein the first and second plurality of fasteners are equally, vertically spaced along each side edge of the gate member.

5. The adjustable-width barrier of claim 1 wherein each end of the two straps of each respective fastener are adapted to engage in a releasable, locking manner.

6. The adjustable-width barrier of claim 1 wherein each respective fastener is chosen from one of the following: a loop type fastener, a buckle, a snap type fastener, and a hook and eye type fastener.

7. The adjustable-width barrier of claim 1 wherein a portion of each respective fastener includes a surface for non-slip or non-damaging engagement with the respective post of the stairwell.

8. The adjustable-width barrier of claim 1 wherein each of the plurality of rigid, structural support members is removable from the respective vertical channel.

9. The adjustable-width barrier of claim 1 wherein the vertical channels comprise a first outer channel disposed in parallel to and proximate the one side edge of the gate member and a second outer channel disposed in parallel to and proximate the other side edge of the gate member.

10. The adjustable-width barrier of claim 9 wherein the vertical channels comprise an interior channel disposed in parallel to and between the first and second outer channels.

11. The adjustable-width barrier of claim 1 wherein the vertical channels are equally, laterally-spaced from each other along the width of the gate member.

12. The adjustable-width barrier of claim 1 wherein the barrier is partially removable from between the respective posts of opposed banisters of the stairwell by disengaging the first plurality of fasteners from one of the respective posts and manually rolling up the planar, frameless, flexible gate member toward the other of the respective posts.

13. An adjustable-width barricade for removable installation between respective posts of opposed banisters of a stairwell, the respective posts having a vertical height and being positioned a fixed horizontal distance across the stairwell from each other, comprising:

a flexible, frameless, and generally-rectangular barrier member having a height extending between a top edge and a bottom edge of the barrier member and a width extending between each side edge of the barrier member, the height being substantially equal to or less than the vertical height of the respective posts and, when fully expanded, the width being substantially equal to or greater than the fixed horizontal distance between the respective posts;

a plurality of fasteners vertically spaced along the height of the barrier member, one end of each of the plurality of fasteners extending from one side edge of the barrier member and the other end of each of the plurality of fasteners extending from the other side edge of the barrier member, each end having two straps adapted to engage in locking manner around one of the respective posts, each of the plurality of fasteners further having an adjustable length strap extending laterally and internally within the barrier member between the two respective ends; and a plurality of rigid, structural support members, each structural support member inserted within a respective vertical channel extending between the top edge and the bottom edge of the barrier member, each of the vertical channels laterally spaced along the width of the barrier member, wherein the height of the barrier member is rigidly maintained in non-compressible form along the width of the barrier member by the plurality of structural support members inserted within the respective vertical channels;

wherein, when the barrier member is installed between the respective posts using the plurality of fasteners, by tightening at least one of the adjustable length straps of the plurality of fasteners, the width of the barrier member is contracted to match the horizontal distance between the respective posts while simultaneously applying and maintaining lateral tension to the barrier member between the respective posts.

14. The adjustable-width barricade of claim 13 wherein the straps are adapted to engage in locking manner around respective posts of varying size, style, and width.

15. The adjustable-width barricade of claim 14 wherein one of the adjustable length straps of the plurality of fasteners is adjusted to have a shorter length than another of the adjustable length straps of the plurality of fasteners.

16. The adjustable-width barricade of claim 14 wherein an adjusted length of the one or more adjustable length straps of the plurality of fasteners is based in part on the size and shape of the respective posts around which the two straps of the corresponding fasteners engage.

17. The adjustable-width barricade of claim 13 wherein the two straps of each respective fastener engage in locking manner around one of the respective posts using one of the following: a loop type fastener, a buckle, a snap type fastener, or a hook and eye type fastener.

18. The adjustable-width barricade of claim 13 wherein a portion of the two straps of each respective fastener that engage in locking manner around one of the respective posts further include a surface to prevent the two straps from slipping when in engagement with the respective posts.

19. The adjustable-width barricade of claim 13 wherein a portion of the two straps of each respective fastener that engage in locking manner around one of the respective posts further include a surface to prevent the two straps from damaging the respective posts when in engagement with the respective posts.

20. The adjustable-width barricade of claim 13 wherein the plurality of structural support members inserted within the respective vertical channels and the plurality of tightened adjustable length straps work cooperatively to maintain the barrier member in rigid and secure engagement between the respective posts.

* * * * *